US011608672B2

(12) United States Patent
Cohen et al.

(10) Patent No.: US 11,608,672 B2
(45) **Date of Patent: *Mar. 21, 2023**

(54) THERMALLY-EFFICIENT SLIDABLE FENESTRATION ASSEMBLY

(71) Applicants: Shmulik Cohen, Los Angeles, CA (US); Oren Cohen, Los Angeles, CA (US)

(72) Inventors: Shmulik Cohen, Los Angeles, CA (US); Oren Cohen, Los Angeles, CA (US)

( * ) Notice: Subject to any disclaimer, the term of this patent is extended or adjusted under 35 U.S.C. 154(b) by 332 days.

This patent is subject to a terminal disclaimer.

(21) Appl. No.: 16/746,867

(22) Filed: Jan. 18, 2020

(65) Prior Publication Data

US 2020/0165862 A1 May 28, 2020

Related U.S. Application Data

(63) Continuation of application No. PCT/US2018/042572, filed on Jul. 18, 2018.
(Continued)

(51) Int. Cl.
*E06B 3/46* (2006.01)
*E06B 3/263* (2006.01)

(52) U.S. Cl.
CPC ..... *E06B 3/469* (2013.01); *E06B 3/26301* (2013.01); *E06B 3/26303* (2013.01);
(Continued)

(58) Field of Classification Search
CPC ..... E06B 3/4609; E06B 3/4618; E06B 3/263; E06B 3/4636; E06B 3/469;
(Continued)

(56) References Cited

U.S. PATENT DOCUMENTS 3,411,254 A 11/1968 Kessler
3,462,884 A * 8/1969 La Bissoniere ..... E06B 3/26336 49/404

(Continued)

FOREIGN PATENT DOCUMENTS

CN 201567910 U 9/2010
DE 20319907 U1 5/2004

(Continued)

*Primary Examiner* — Jessie T Fonseca
(74) *Attorney, Agent, or Firm* — Lance M. Pritikin

(57) ABSTRACT

Exemplary implementations of a thermally-efficient slidable fenestration assembly are glass window systems or glass door systems having one or more sliding glass panels. The fenestration assemblies are adapted to be mounted in an architectural structure such as a building or house. Accessory channels in the fenestration framework may be provided to facilitate nail-fin, retro-fit or screen adaptors as means to attach the assembly to the surrounding architecture. Stiles, tracks and rails of the assembly are specifically configured to reduce heat transfer across the fenestration assembly, while simultaneously maintaining the structural integrity and durability of the overall assembly. Certain stile, track and rail components may comprise materials of relatively low conductivities. Preferred stile configurations include interlock elements arranged to reduce the assembly's vulnerability to tampering from a position outside of the fenestration.

6 Claims, 15 Drawing Sheets

Related U.S. Application Data

(60) Provisional application No. 62/534,194, filed on Jul. 18, 2017.

(52) U.S. Cl.
CPC ..... *E06B 3/26347* (2013.01); *E06B 3/4609* (2013.01); *E06B 2003/2633* (2013.01); *E06B 2003/26327* (2013.01); *E06B 2003/26381* (2013.01); *E06B 2003/26383* (2013.01); *E06B 2003/26385* (2013.01)

(58) Field of Classification Search
CPC ..... E06B 3/26347; E06B 3/26303; E06B 3/26301; E06B 2003/26381; E06B 2003/26385; E06B 2003/2633; E06B 2003/26383; E06B 2003/26327
See application file for complete search history.

(56) References Cited

U.S. PATENT DOCUMENTS

| | | | | |
|---|---|---|---|---|
| 3,530,618 | A * | 9/1970 | Grossman | E06B 3/4618 49/504 |
| 3,992,769 | A | 11/1976 | Jackson | |
| 4,064,653 | A * | 12/1977 | Randall | E06B 3/26347 49/458 |
| 4,151,682 | A | 5/1979 | Schmidt | |
| 4,202,137 | A | 5/1980 | Randall | |
| 4,229,905 | A * | 10/1980 | Rush | E06B 3/4609 49/471 |
| 4,275,526 | A | 6/1981 | Abramson | |
| 4,314,424 | A | 2/1982 | Gordon et al. | |
| 4,447,985 | A | 5/1984 | Weber et al. | |
| 4,483,099 | A | 11/1984 | Schmidt | |
| 4,642,870 | A | 2/1987 | Schulz | |
| 4,704,839 | A | 11/1987 | Kay | |
| 4,726,147 | A | 2/1988 | Beske et al. | |
| 5,038,537 | A | 8/1991 | Frambach | |
| 5,363,628 | A | 11/1994 | Basar et al. | |
| 5,469,683 | A | 11/1995 | McKenna et al. | |
| 5,551,196 | A | 9/1996 | Paredes et al. | |
| 5,768,836 | A | 6/1998 | Bachmann | |
| 6,311,439 | B1 | 11/2001 | Arcati et al. | |
| 6,427,397 | B1 | 8/2002 | Kolaschnik | |
| 6,613,404 | B2 | 9/2003 | Johnson | |
| 7,987,633 | B2 | 8/2011 | Lenox et al. | |
| 8,001,743 | B2 | 8/2011 | Lambertini | |
| 8,322,090 | B2 | 12/2012 | Moriya et al. | |
| 8,484,902 | B1 | 7/2013 | Brown et al. | |
| 9,133,614 | B2 | 9/2015 | Clark | |
| 2003/0126812 | A1 | 7/2003 | Folsom et al. | |
| 2006/0260227 | A1 | 11/2006 | Winfield | |
| 2008/0092452 | A1 * | 4/2008 | Chubb | E05D 15/0621 49/458 |
| 2008/0282627 | A1 * | 11/2008 | Lenox | E06B 7/205 52/204.63 |
| 2014/0090324 | A1 | 4/2014 | Houben | |
| 2015/0159422 | A1 | 6/2015 | Pettit, III | |
| 2016/0097235 | A1 | 4/2016 | Curcija | |
| 2018/0038144 | A1 * | 2/2018 | Metzger | E06B 3/469 |
| 2020/0109595 | A1 * | 4/2020 | Woodward | E06B 3/66304 |

FOREIGN PATENT DOCUMENTS

| | | | |
|---|---|---|---|
| EP | 0559332 | A2 | 9/1993 |
| EP | 1580387 | A2 | 9/2005 |
| WO | 2016050839 | A1 | 4/2016 |

* cited by examiner

THERMALLY-EFFICIENT SLIDABLE FENESTRATION ASSEMBLY

RELATED APPLICATIONS

This application is a bypass continuation of PCT International Patent Application No. PCT/US2018/042572 filed Jul. 18, 2018, which claims the benefit of U.S. Provisional Application No. 62/534,194 filed Jul. 18, 2017, the content of each of which is incorporated by this reference in its entirety for all purposes as if fully set forth herein.

TECHNICAL FIELD

The present invention relates generally to sliding fenestration systems such those associated with multi-panel sliding glass doors or horizontal and vertical windows. More particularly, the present invention relates to slidable fenestration assemblies which are highly energy-efficient.

BACKGROUND

Conventional slidable fenestration systems include single-slide or multi-slide glass window systems or sliding glass door systems. Many such systems are conventionally adapted to be mounted in an architectural structure such as a building or house. This mounting may be accomplished by way of, for example, block fit (block frame), retro-fit, nail-fin, or flush fin interfaces. Moreover, it is often preferable for fenestration systems to be designed to reduce heat transfer between the inside of the architectural structure and the outside of the architectural structure through the fenestration system. Such systems are frequently described as thermally-efficient, and are often designated with a U-factor which defines the quality of the system's insulating properties (resistance to heat flow).

What are needed are slidable fenestration assemblies which provide for improved thermal efficiencies, and are thus capable of reliably achieving, in their completely closed configurations, a U-factor of below 0.32, and as low as 0.28 or lower.

SUMMARY

Certain deficiencies of the prior art are overcome by the provision of features and implementations of slidable fenestration assemblies in accordance with the present disclosure. Such features and implementations represent improvements, particularly increased thermal efficiencies, over conventional fenestration systems.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
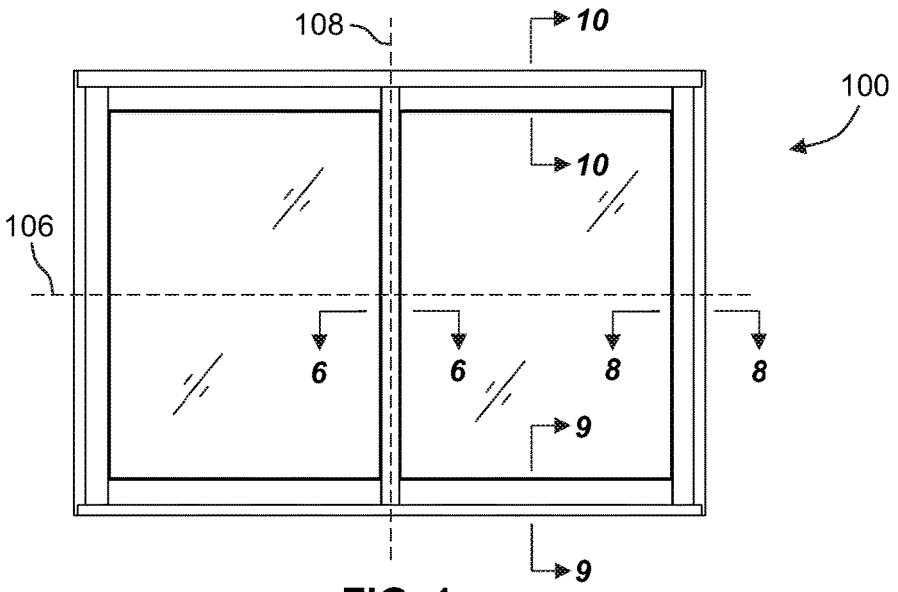
FIG. 1 is a diagrammatic front view of one example implementation of a slidable fenestration assembly in accordance with the present disclosure, wherein the assembly comprises multiple panel elements, at least one of which is slidable with respect to the other(s)

Referring now to the drawings, like reference numerals designate identical or corresponding features throughout the several views.

With reference to the FIGS. 1-5, certain preferred embodiments of a slidable fenestration assembly are depicted at 100. Implementations of a slidable fenestration assembly in accordance with the present disclosure may be, for example, an energy-efficient single-slide or multi-slide glass window system or sliding glass door system capable of achieving, in their completely closed configurations, a U-factor of below 0.32, and as low as 0.28 or lower. Moreover, a slidable fenestration assembly in accordance with the present disclosure may be adapted to be mounted in an architectural structure such as a building or house. Depending upon the application, such mounting may be by way of, for example, block fit (block frame), retro-fit, nail-fin (e.g., new construction), flush fin, other conventional fenestration mounting means or the like. Accessory channels (e.g., adaptor channels) in the framework 102, such as those features shown at 144 in FIGS. 8-10, may be provided to facilitate nail-fin, retro-fit or screen adaptors.

Figure 2:
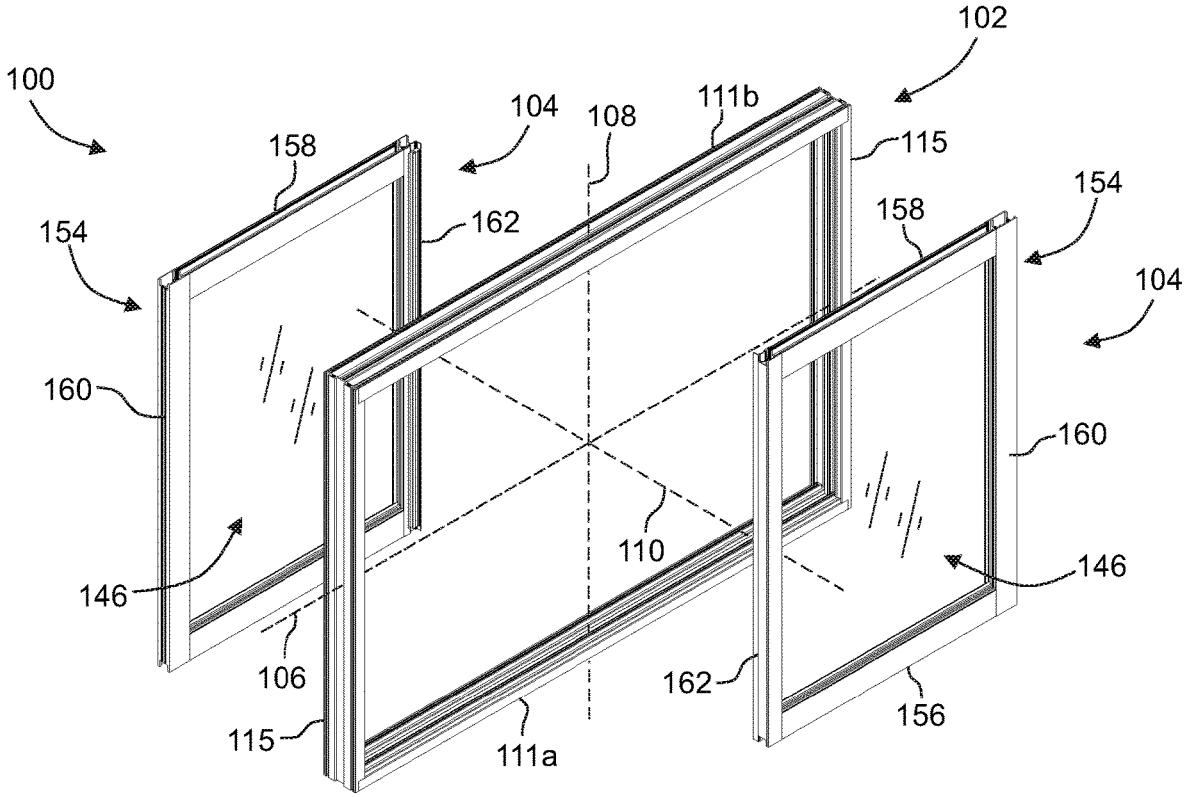
FIG. 2 is a diagrammatic exploded perspective view of the fenestration assembly implementation shown in FIG. 1, but with two panel elements shown removed from a framework.
Figure 3:
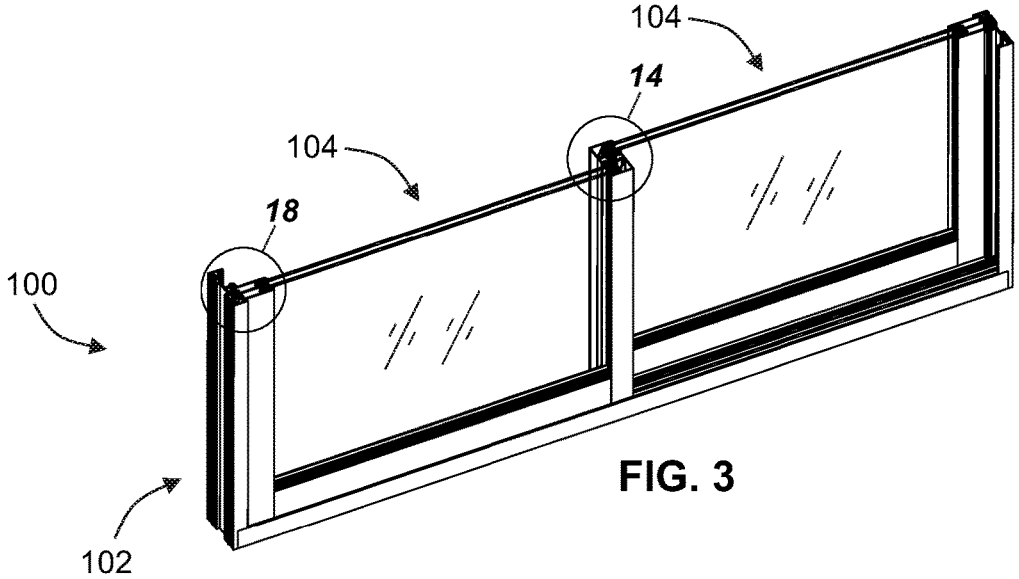
FIG. 3 is a diagrammatic perspective view of a lower sectioned portion of the fenestration assembly shown in FIG. 1, wherein the section cut is collinear with lines 6-6 and 8-8 in FIG. 1, both panel elements are shown in closed position with respect to one another, and the fenestration assembly is in a fully-closed configuration.
Figure 4:
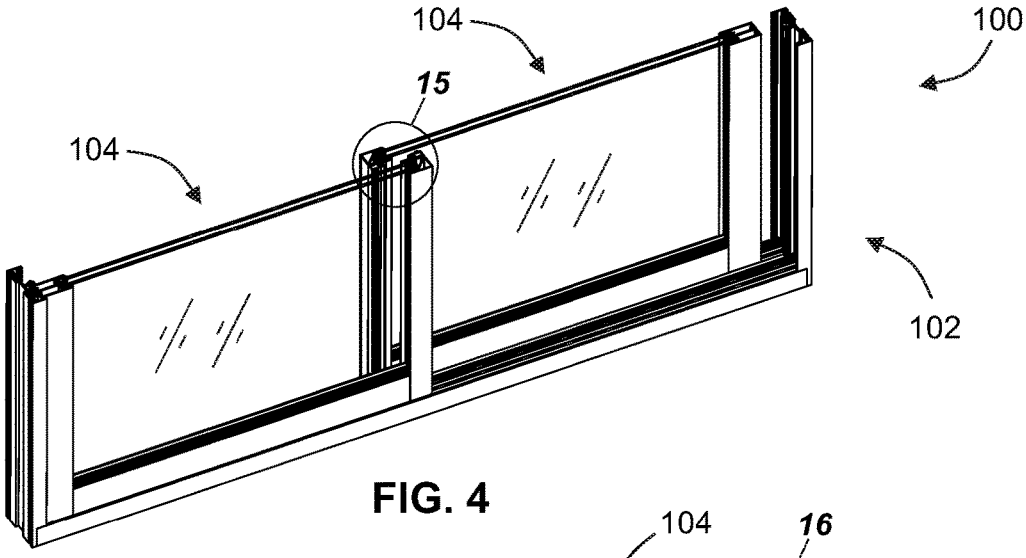
FIG. 4 is a diagrammatic perspective view similar to that of FIG. 3, but wherein a first panel element is shown in an open position with respect to a second panel element.
Figure 5:
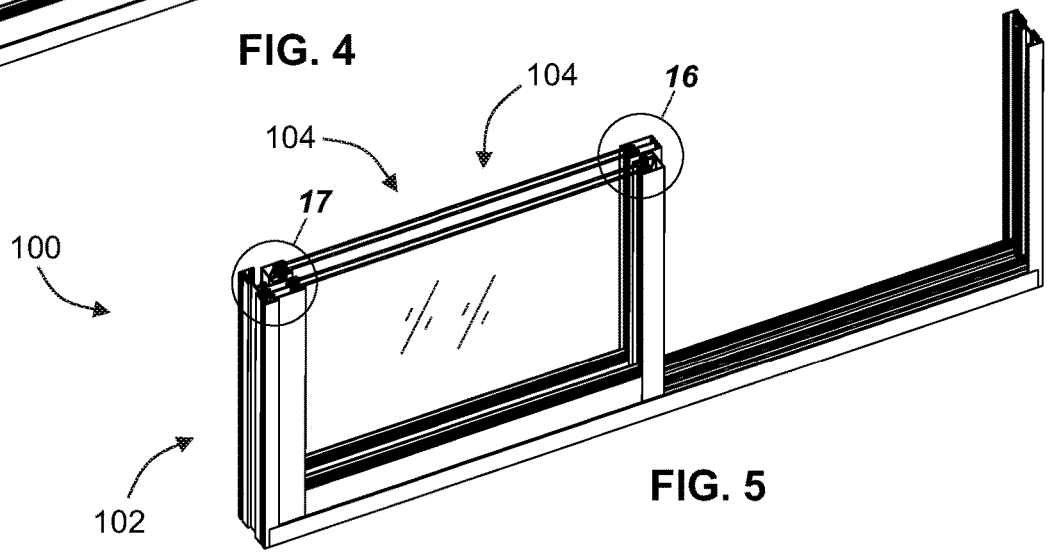
FIG. 5 is a diagrammatic perspective view similar to that of FIG. 4, but wherein a first panel element is shown in a fully-open position with respect to a second panel element.

Referring to FIGS. 1 and 2, a slidable fenestration assembly 100 may have a longitudinal axis 106, an orthogonal axis 108 and transverse axis 110. These axes are preferably defined perpendicularly to one another. Depending upon the particular construction application, the slidable fenestration assembly 100 may be configured to be installed with the longitudinal axis 106 (e.g., the panel slide axis) oriented vertically with respect to a local horizontal plane, such as the foundation or floor of a house or building. Contrastingly, the slidable fenestration assembly 100 may be installed with the longitudinal axis oriented horizontally with respect to a local horizontal plane.

Preferred embodiments of a slidable fenestration assembly 100 may comprise a framework 102 and one or more panel elements 104. Referring to FIG. 2, preferred implementations of a framework 104 may include one or more of, or some combination of, a proximal track 111*a*, a distal track 111*b*, and jambs 115. The proximal track 111*a* and distal track 111*b* may be opposingly disposed along the orthogonal axis 108. A pair of jambs 115 may be opposingly disposed along the longitudinal axis 106. Preferred implementations of a panel element 104 may include a glazing element 146 and a sash 154 (i.e., panel frame). The sash 154 may include one or more of, or some combination of, a proximal rail 156, a distal rail 158, an end stile 160 and an interlock stile 162. In implementations of the slidable fenestration assembly 100, at least one of the panel elements 104 is slidably retained within the framework 102. In particular implementations of the slidable fenestration assembly 100 having multiple panel elements 104, at least one of the panel elements 104 may be non-slidably affixed within the framework 102.

Figure 6:
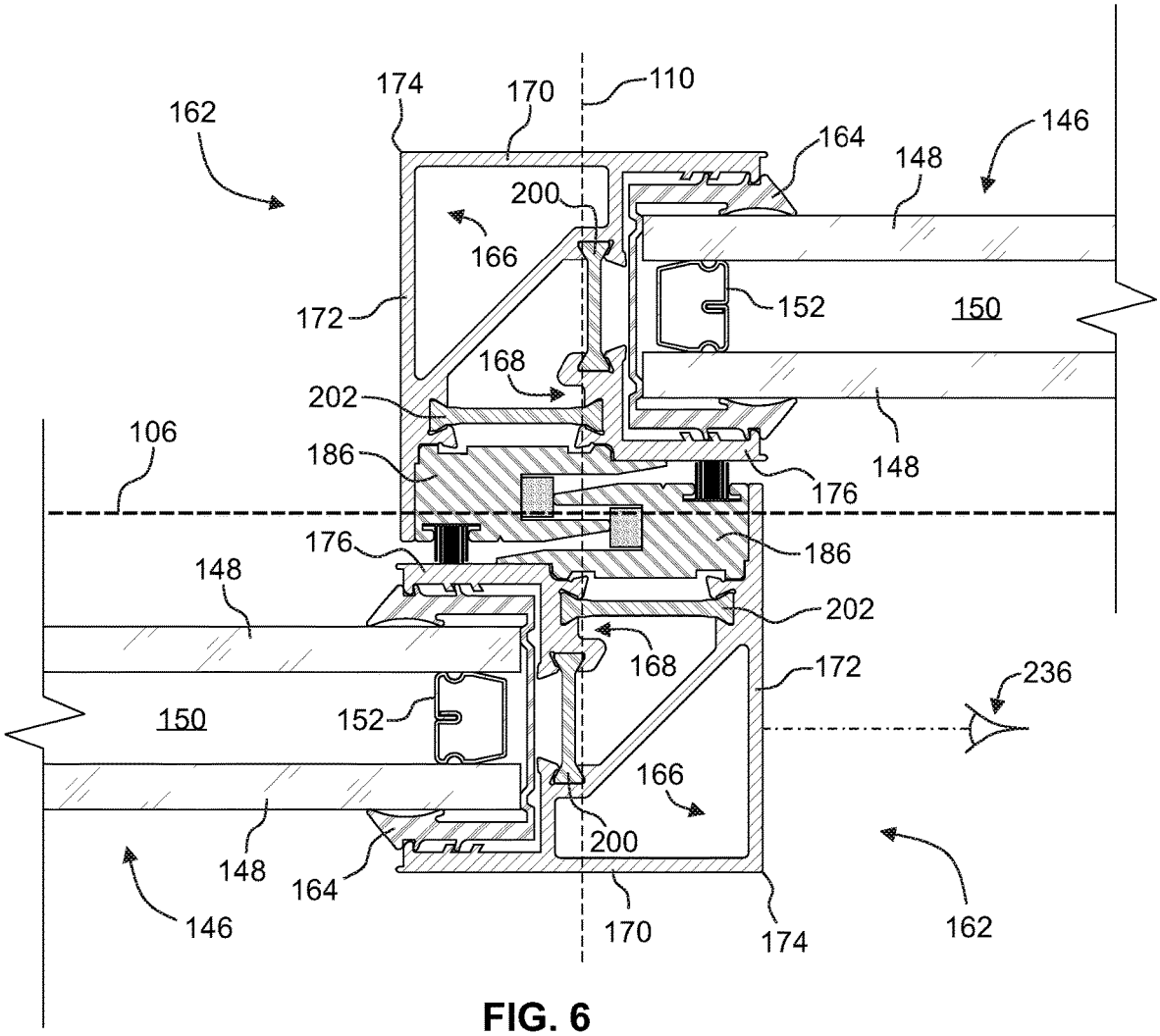
FIG. 6 is a diagrammatic cross-sectional view taken along line 6-6 of FIG. 1, wherein two adjacent panel members are in closed position with respect to one another, and the corresponding interlock stiles are shown in mutually-interlocked configuration.

Referring to FIG. 6, a glazing element 146 may include one or more panes 148 arranged parallel to one another. Each pane may be comprised of glass, Acrylic, polycarbonate, or the like. In addition, each pane 148 may be treated with one or more coatings such as, for example, one or more layers of a low-emission (otherwise commonly referred to as "Low-E") coating or film. In glazing elements comprising two or more panes 148, the panes 148 may be separated by a cavity 150. The width of a cavity 150 may be maintained, at least in part, by a spacer 152. The cavity 150 may be filled with a gas such as Argon, carbon dioxide, Freon, Krypton, a combination thereof or the like. In certain implementations of a glazing element 146, a Low-E film (not shown) may be suspended within the cavity 150 between a pair of panes 148. Referring to FIGS. 2 and 6-10, a glazing element 146 may be planar and have peripheral edge portions, each edge portion being receivable by respective glazing channels in sash components such as the interlock stile 162 (see, e.g., FIG. 12), proximal rail 156, distal rail 158, and end stile 160.

Figure 7:
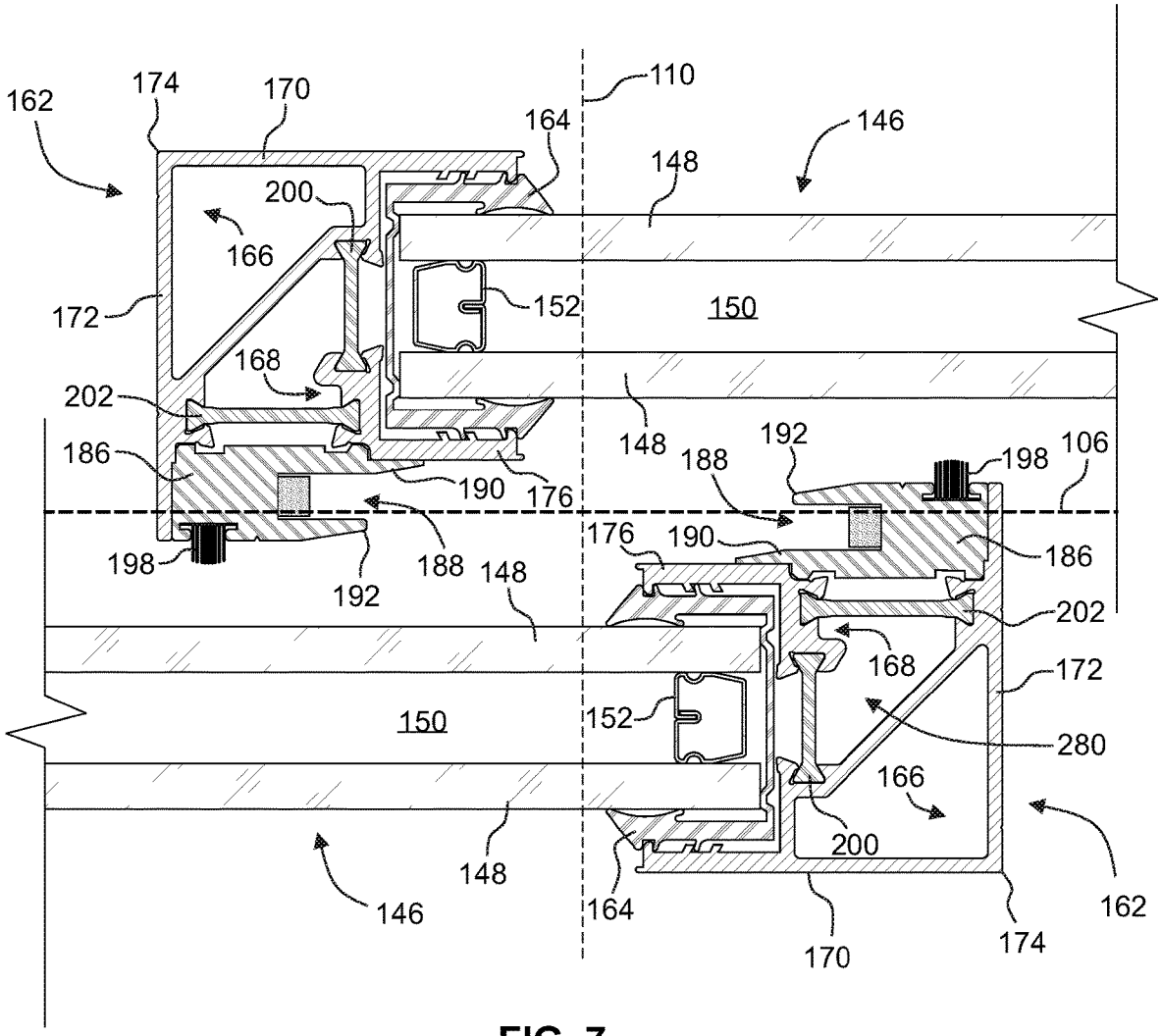
FIG. 7 is a diagrammatic cross-sectional view similar to that of FIG. 6, but wherein the two adjacent panel members are in an open position with respect to one another, and the corresponding interlock stiles are shown out of mutually-interlocked configuration.
Figure 11:
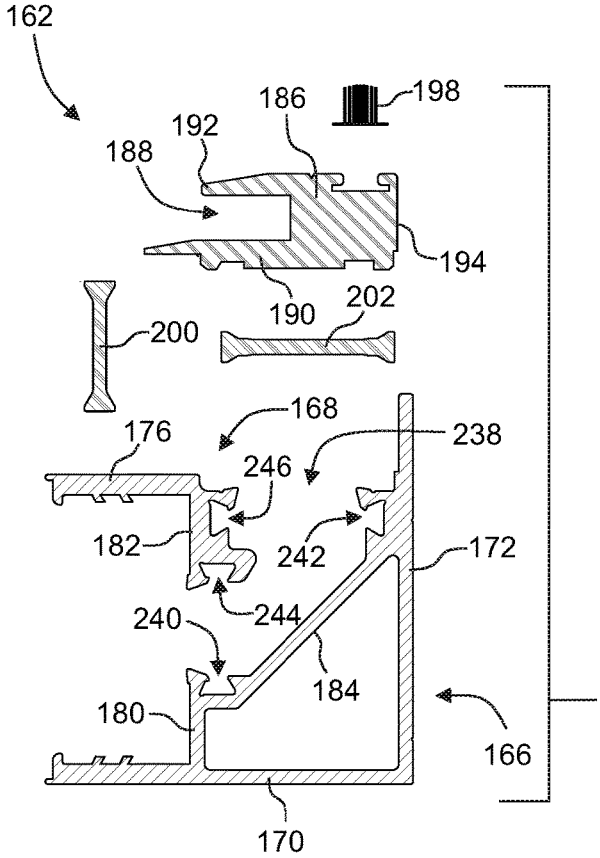
FIG. 11 is a diagrammatic cross-sectional view one example implementation of an interlock stile in accordance with the present disclosure.
Figure 12:
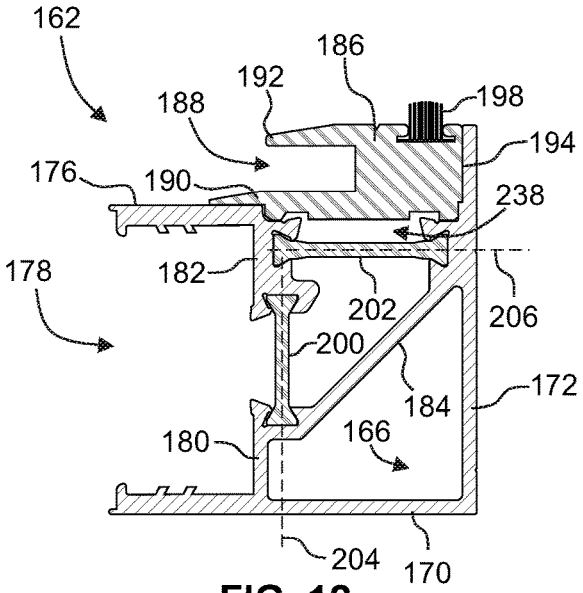
FIG. 12 is a diagrammatic cross-sectional view of the interlock stile of FIG. 11, but shown in assembled configuration.

Referring to FIGS. 6, 11 and 12, an interlock stile 162 may include an outboard section 166, an inboard section 168, an interlock first thermal break 200, an interlock second thermal break 202, and an interlock element 186. The outboard section 166 may have an outer facing wall 170 and a lateral facing wall 172 perpendicular to one another. The outer facing wall 170 and lateral facing wall 172 may intersect with one another at an outboard edge 174. The inboard section 168 is preferably materially discontinuous with the outboard section 166, and may have an inner facing wall 176. The interlock stile 162 may further include an interlock stile glazing channel 178 in receiving engagement with one of the peripheral edge portions of the glazing element 146. In certain preferred implementations of the interlock stile 162, the interlock stile glazing channel 178 may be defined at least in part by mutually-opposing disposition of the outer facing wall 170 and the inner facing wall 176. A glazing gasket 164 may be disposed between the glazing channel and the respective peripheral edge of the glazing element 146, so as to help protectively secure the glazing element within the glazing channel and prevent gas from escaping from the cavity 150. The interlock first thermal break 200 may be secured in coupling communication between the outer facing wall and the inboard section. The interlock second thermal break 202 may be secured in coupling communication between the lateral facing wall 170 and the inboard section 168. As illustrated in FIGS. 6 and 7 for example, such securement may be by way of clamping or crimped engagement between respective break nodes of the outboard and inboard section and respective ends of the interlock first and second thermal breaks.

In particular preferred implementations of the interlock stile 162, the interlock first thermal break 200, the interlock second thermal break 202 and the interlock element 186 may have relatively low thermal conductivities compared to the outboard section 166 and the inboard section 168. By way of example, the interlock stile thermal breaks (and the other thermal breaks disclosed herein) may be comprised of, for example, 6/6 Polyamide Nylon or the like, and the interlock element 186 may be comprised of PVC, another polymer with low thermal conductivity, or the like. Contrastingly, the outboard section 166 and the inboard section 168 may be comprised of aluminum or a similar metal.

Figure 21:
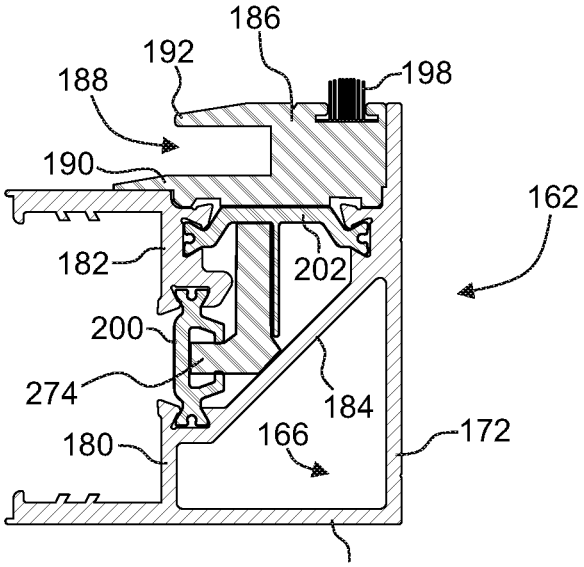
FIG. 21 is a diagrammatic cross-sectional view of a further alterative implementation of an interlock stile, wherein an auxiliary thermal break is installed in an inboard cavity.
Figure 22:
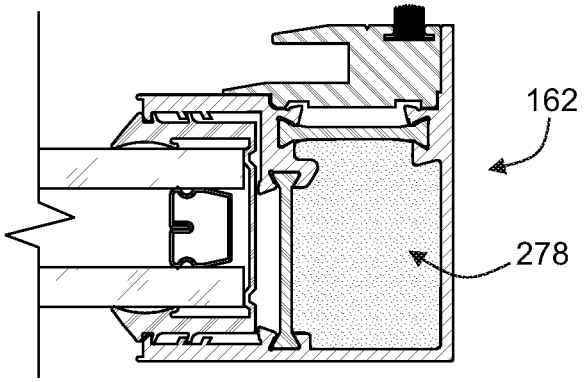
FIG. 22 is a diagrammatic cross-sectional view of a further alterative implementation of an interlock stile, wherein a foam insulation material fills an interlock cavity.

Referring to FIG. 21, an alternate implementation of an interlock stile 162 is shown with variations in the shapes of the interlock first thermal break 200 and interlock second thermal break 202, and an interlock stile auxiliary break 274 (e.g., extruded PVC or the like). Referring to FIG. 22, a further alternate implementation of an interlock stile 162 is shown wherein an interlock stile cavity is filled with a foam insulation material 278. Referring to FIG. 7, an inboard cavity 280 may optionally be filed with foam insulation.

Referring to FIG. 12, in certain preferred implementations of the interlock stile 162, the interlock first thermal break 200 may have an extrusion cross-section elongated along an interlock first break axis 204 and the interlock second thermal break 202 may have an extrusion cross-section elongated along an interlock second break axis 206. The interlock first and second break axes may be non-parallel to one another. For example, as shown in the particular implementation illustrated in FIG. 12, the interlock first break axis 204 and interlock second break axis 206 may be perpendicular to one another. It is envisioned that in alternative implementations, the interlock first break axis 204 and interlock second break axis 206 may be set at various other angles with respect to one another, such as 30 degrees, 45 degrees, 60 degrees or the like.

Referring to FIGS. 11 and 12, an interlock element 186 may have an interlock channel 188 with a channel opening (i.e., at the open end or "mouth" of the interlock channel 188), and an interlock base wall 190 and an interlock engagement lip 192 in opposing disposition with respect to one another to at least partially define the interlock channel 188. In certain preferred implementations of an interlock stile 162, the interlock base wall 190 may be secured to the outboard section 166 and the inboard section 168 so as to bridge an interlock gap 238 defined between the lateral facing wall 172 and the inner facing wall 176. The interlock element 186 may include an opposing face 194 disposed oppositely of the channel opening. The interlock element 186 may be affixed to the remainder of the interlock stile by way of, for example, screws or rivets (not shown) connecting the interlock element 186 to the interlock second thermal break 202.

Figure 13A:
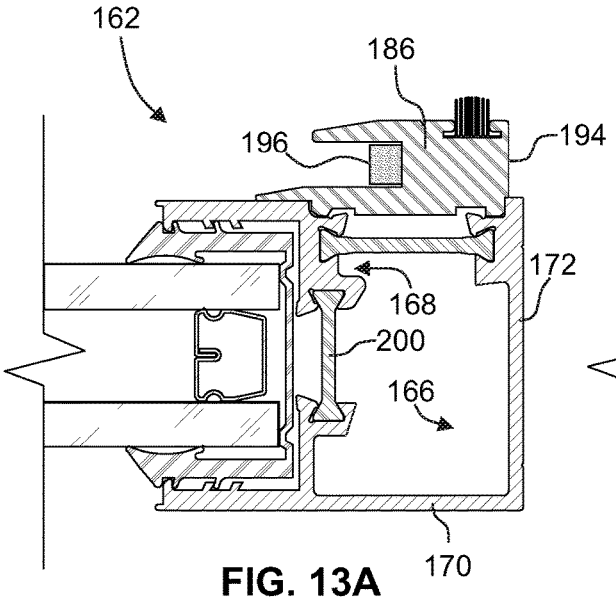
FIG. 13A is a diagrammatic cross-sectional view of one alterative implementation of an interlock stile.
Figure 13B:
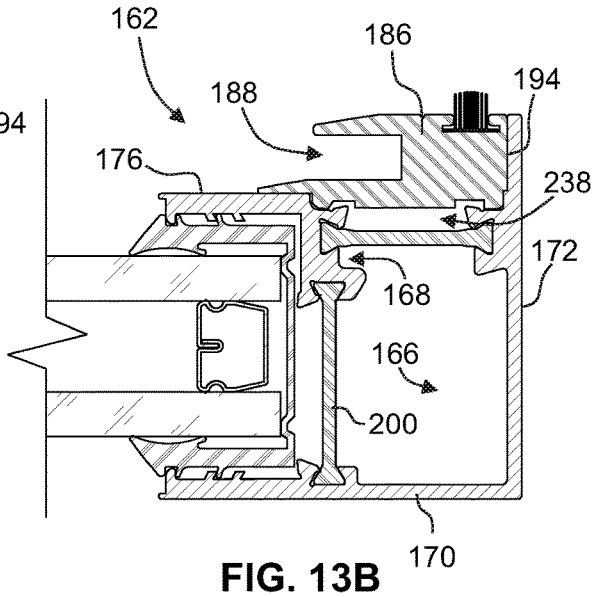
FIG. 13B is a diagrammatic cross-sectional view of a further alterative implementation of an interlock stile.
Figure 14:
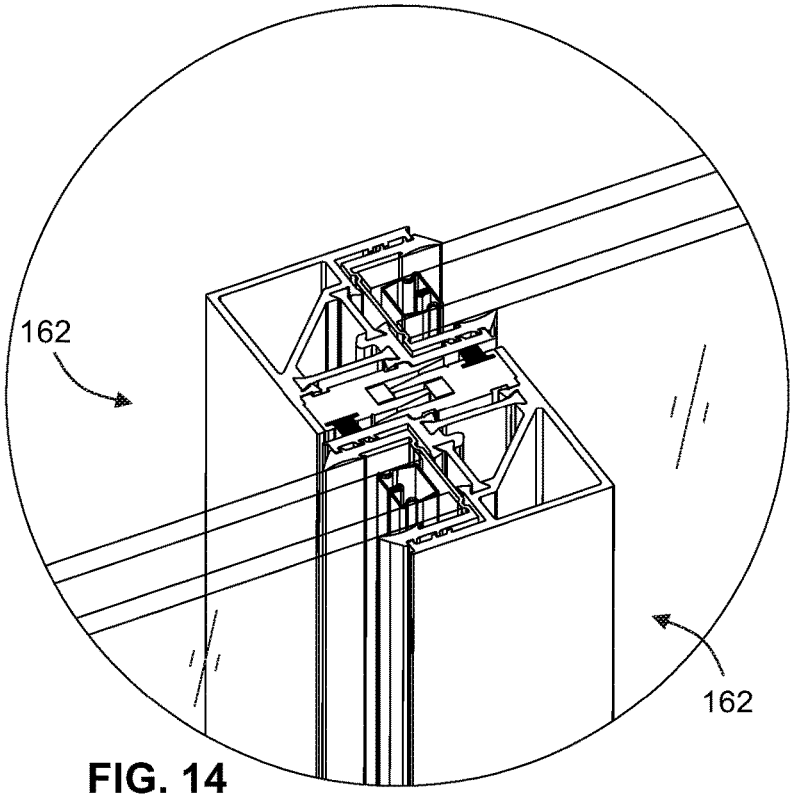
FIG. 14 is a diagrammatic magnified view of detail 14 in FIG. 3.
Figure 15:
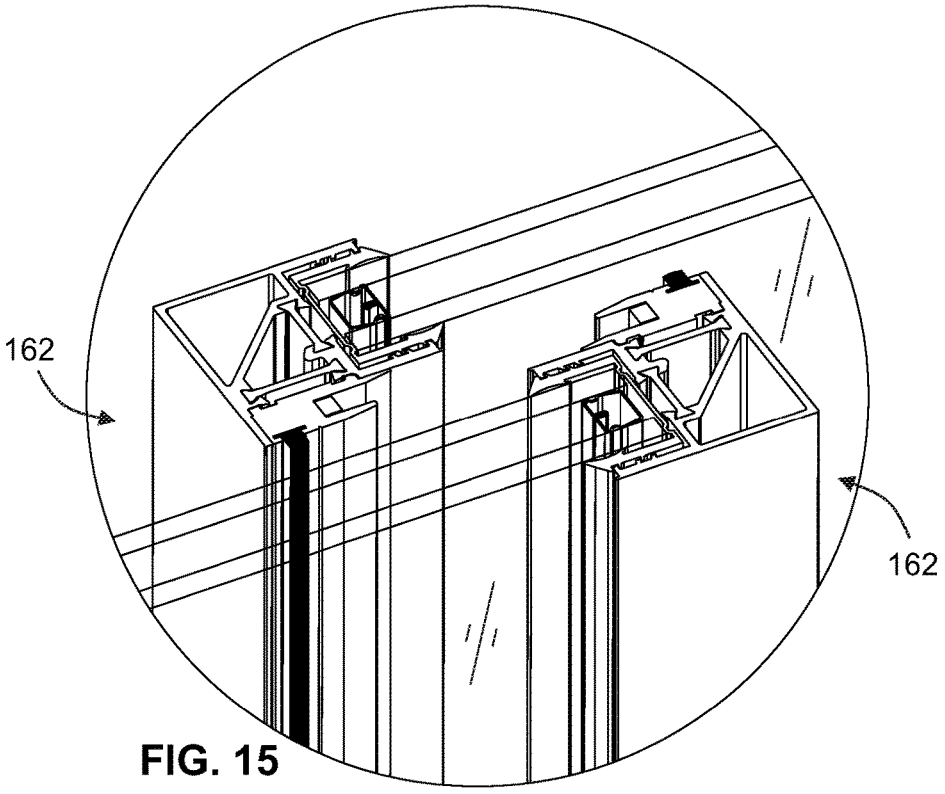
FIG. 15 is a diagrammatic magnified view of detail 15 in FIG. 4.
Figure 16:
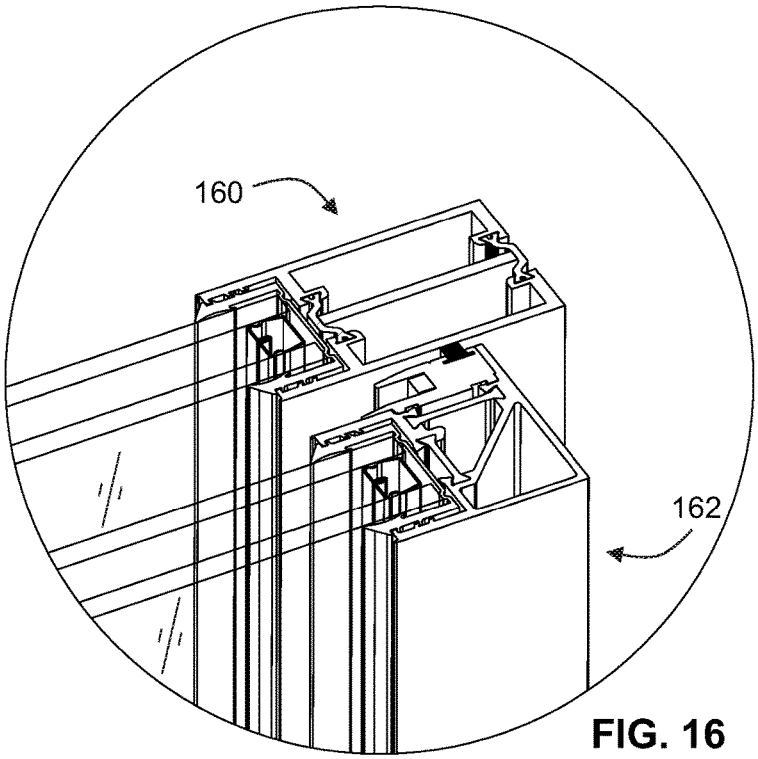
FIG. 16 is a diagrammatic magnified view of detail 16 in FIG. 5.
Figure 17:
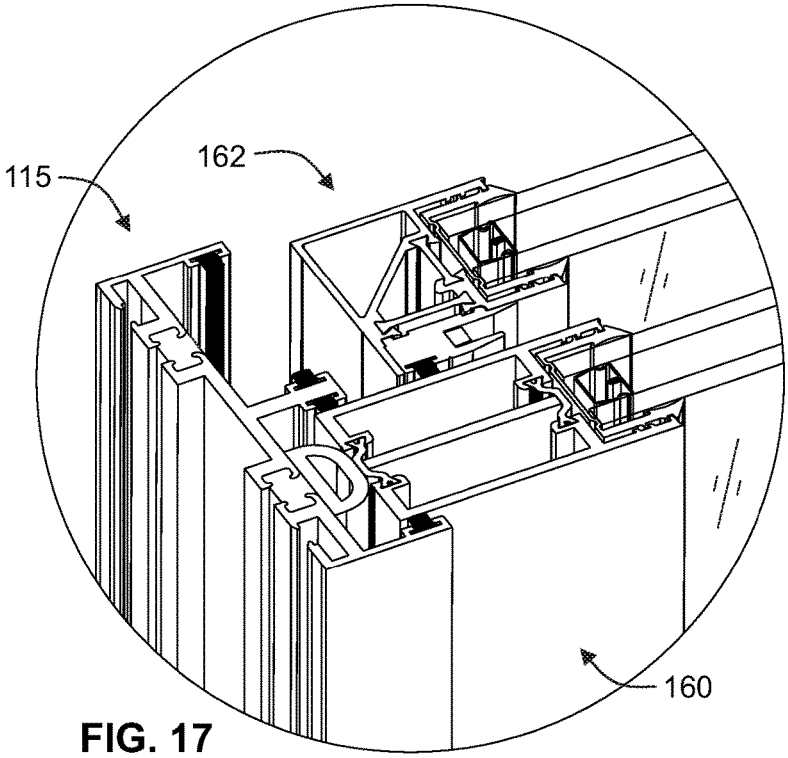
FIG. 17 is a diagrammatic magnified view of detail 17 in FIG. 5.
Figure 18:
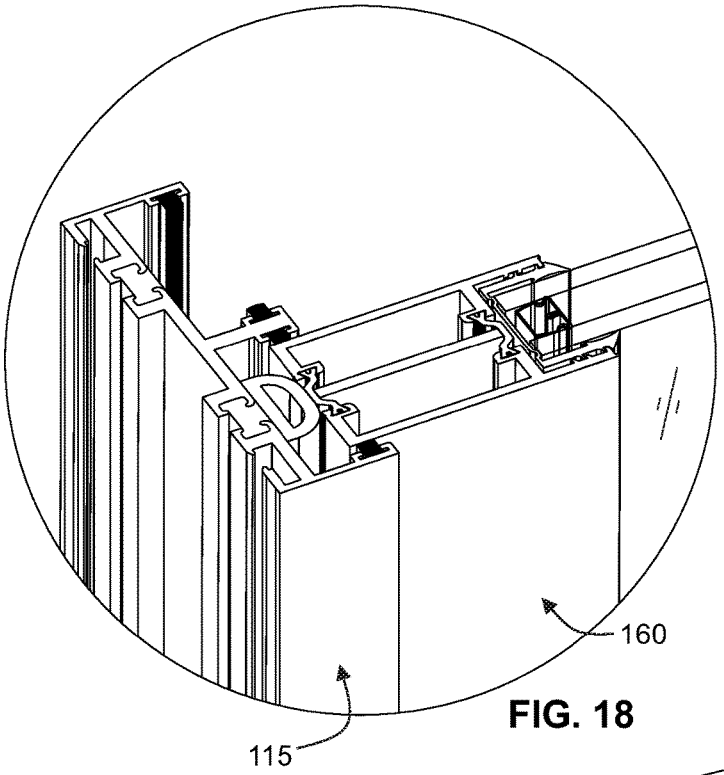
FIG. 18 is a diagrammatic magnified view of detail 18 in FIG. 3.

Referring to FIGS. 13A and 13B, the lateral facing wall 172 may be materially continuous, and may extend from the outer facing wall 170 to the interlock element 186, and across at least a portion of the opposing face 190. Moreover, with reference to FIGS. 6 and 13B, the lateral facing wall 172 may extend most or all of the way across the opposing face 190 so as conceal the remainder of the interlock stile 162 from a viewpoint 236 outward of and normal to the lateral facing wall 172. This construction improves the aesthetics of the interlock stile while also protecting the interlock element 186 from being tampered with from a position outside of the interlock stile 162.

Referring to FIGS. 11-13B, in certain preferred implementations of the interlock stile 162, the outboard section 166 may include an interlock first break node 240 extending inward from the outboard facing wall 170 and an interlock second break node 242 extending inward from the lateral facing wall 172. The inboard section 168 may include an interlock third break node 244 and an interlock fourth break node 246. The interlock first thermal break 200 may be received in clamping securement by the interlock first break node 240 and the interlock third break node 244. The interlock second thermal break 202 may be received in clamping securement by the interlock second break node 242 and the interlock fourth break node 246. Referring to FIGS. 11 and 12, the outboard section 166 may include an interlock bracing wall 184. The interlock bracing wall 184 may extend, for example, from the interlock first break node 240 to the interlock second break node 242.

Referring to FIGS. 11 and 12, the interlock first break node 240 may extend inward from the outer facing wall 170 by way of a channel floor outboard segment 180. The interlock third break node 244 may extend inward from the inner facing wall 176 by way of a channel floor inboard segment 182. The channel floor outboard segment 180 and channel floor inboard segment 182 may define, at least in part, a floor portion of the interlock stile glazing channel 178. As illustrated in FIGS. 11 and 12 for example, the interlock fourth break node 246 may be disposed along the channel floor inboard segment 182 between the inner facing wall 176 and the interlock third break node 244.

Particular preferred implementations of a slidable fenestration assembly 100 may comprise a first and a second panel element 104. The first panel element 104 may be slidably movable along the longitudinal axis 106 between an open position (see, e.g., FIGS. 4 and 5) and a closed position (see, e.g., FIGS. 1 and 3) with respect to the second panel element. Referring to FIG. 6, the interlock channel 188 of the first panel element 104 is in receipt of the interlock engagement lip 192 of the second panel element 104 when the first panel element 104 is in its closed position.

Referring to FIGS. 7, 11 and 13A, in certain preferred implementations of a slidable fenestration assembly 100, a respective interlock brush strip 198 may be affixed to each interlock element 186 oppositely of its interlock base wall 190. A respective interlock bumper 196 may be disposed within each interlock channel 188. The interlock bumper 196 may be made of a compressible polymer or the like. Referring to FIG. 6, when the first panel element 104 is in its closed position, (i) the interlock brush strip 198 of the first panel element may sealingly engage the inner facing wall 176 of the second panel element; (ii) the interlock brush strip 198 of the second panel element may sealingly engage the inner facing wall 176 of the first panel element; (iii) the interlock engagement lip 192 of the first panel element may sealingly engage the interlock bumper 196 of the second panel element; and (iv) the interlock engagement lip 192 of the second panel element may sealingly engage the interlock bumper 196 of the first panel element.

Preferred implementations of a slidable fenestration assembly 100 may comprise a framework 102 within which the one or more panel elements 104 are mounted. Certain implementations of a slidable fenestration assembly 100 may comprise, for example, 2, 3, 4, or more panel elements 104, some or all of which may be slidable with respect to one another along the longitudinal axis 106 within the framework 102. The features, components and subassemblies disclosed herein can be applied to a variety of sliding fenestration configurations with any number of panel elements and corresponding track channels. For example, in a fenestration assembly with 3 or more panel elements, at least one interlock stile 162 (i.e., in a panel disposed between two other panels) may be configured with a pair of opposingly-disposed interlock elements 186 arranged such that the interlock channels 188 of each of the pair of interlock elements open in opposite directions.

Figure 9:
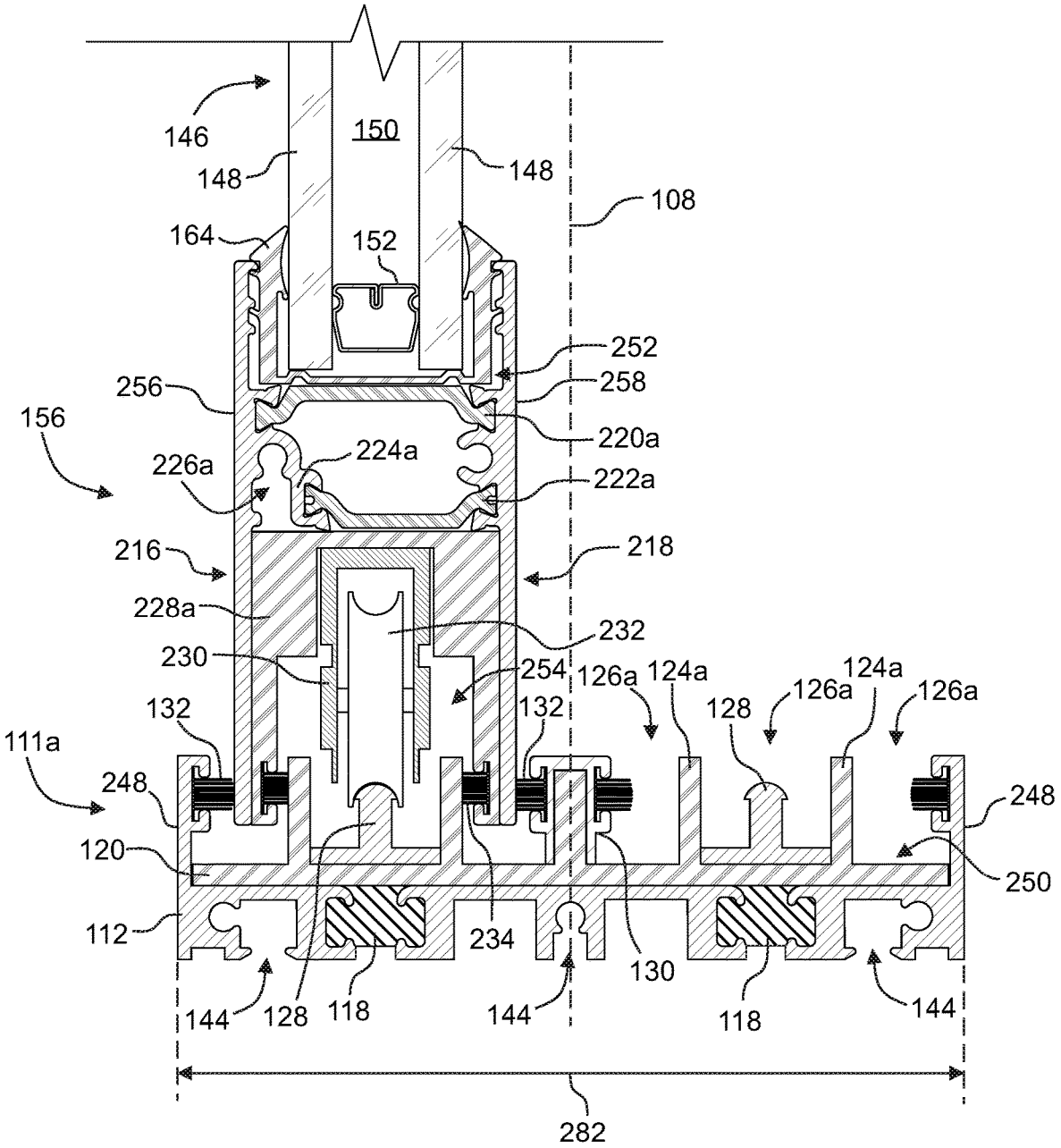
FIG. 9 is a diagrammatic cross-sectional view taken along line 9-9 of FIG. 1, illustrating an example proximal rail of a panel element in guided and rollable engagement with an example proximal track of a framework.

Referring to FIG. 9, the framework 102 may include a proximal track 111*a* and a corresponding first panel element 104 may include a proximal rail 156. The proximal track 111*a* may have a proximal track frame member 112, a proximal track insert 120 and a track element 128. The proximal track frame member 112 may include a pair of proximal transverse facing walls 248 defining a proximal insert channel 250 therebetween. The proximal track insert 120 may be disposed within the proximal insert channel 250 and may have a plurality of proximal track channel walls 124*a* defining proximal track channels 126*a* interposed laterally thereof. The track element 128 may be disposed within a respective one of the proximal track channels 126*a*.

Referring again to FIG. 9, the proximal rail 156 may have a proximal rail first section 216, a proximal rail second section 218, proximal rail glazing channel 252, a proximal shoe channel 254, a proximal first thermal break 220*a* and a proximal second thermal break 222*a*. The proximal rail first section 216 may have a proximal first facing wall 256. The proximal rail second section 218 may be materially discontinuous with the proximal rail first section 216 and may have a proximal second facing wall 258 disposed oppositely of the proximal first facing wall 256. The proximal rail glazing channel 252 may be in receiving engagement with one of the peripheral edge portions of the respective glazing element 146, and may be defined between the proximal first and second facing walls. The proximal shoe channel 254 may also be defined between the proximal first and second facing walls, but disposed oppositely of the proximal rail glazing channel 252. A proximal rail shoe 228*a* may be disposed within the proximal shoe channel 254. One or more roller assemblies 230 may be disposed within the proximal rail shoe 228*a* and have one or more wheels 232 in engagement with the track element 128 so as to be guidedly rollable thereon. Shoe brush strips 234 may be affixed to the proximal rail shoe to laterally-engage respective proximal track channel walls 124*a*. The proximal first thermal break 220*a* may be secured in coupling communication between the proximal first and second facing walls. Similarly, the proximal second thermal break 222*a* may be secured in coupling communication between the proximal first and second facing walls.

Figure 19:
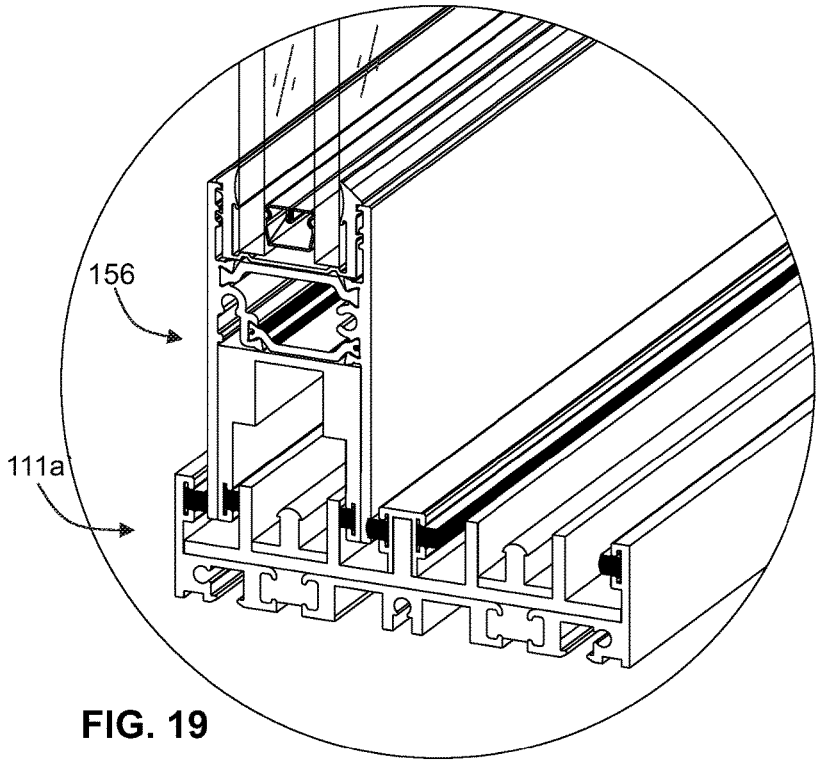
FIG. 19 is a diagrammatic magnified perspective view of a sectioned portion of the fenestration assembly shown in FIG. 1, wherein the section cut is along line 9-9 in FIG. 1, and a slidable guiding engagement between an example proximal rail and an example proximal track is illustrated.

In certain preferred implementations of the slidable fenestration assembly 100 with interfacing proximal track and rail subassemblies (e.g., as illustrated in FIGS. 9 and 19), the proximal track insert 120 may have a relatively low thermal conductivity compared to all or portions of the proximal track frame member 112. For example, the proximal track insert 120 may be comprised of PVC, another polymer with low thermal conductivity, or the like. In contrast, the proximal track frame member 112 may be comprised primarily of aluminum, with frame thermal breaks 118 comprising polyurethane or the like (e.g., formed by "pour and debridge" process). The track element may be comprised of a metal (such as aluminum, iron, stainless steel) or a plastic. Therefore, the proximal track insert 120 may also have a relatively low thermal conductivity compared the track element 128, and may be disposed in thermally-insulative communication between the proximal track frame member 112 and the track element 128. The proximal first thermal break 220*a*, proximal second thermal break 222*a*, and the proximal rail shoe 228*a* may have relatively low thermal conductivities compared to the proximal rail first section 216 and proximal rail second section 218. For example, the proximal first thermal break 220*a* and proximal second thermal break 222*a* may be comprised of 6/6 polyamide Nylon or the like, the proximal rail shoe 228*a* may comprise PVC, another polymer with low thermal conductivity, or the like, and the proximal rail first section 216 and proximal rail second section 218 may comprise aluminum or the like.

Figure 10:
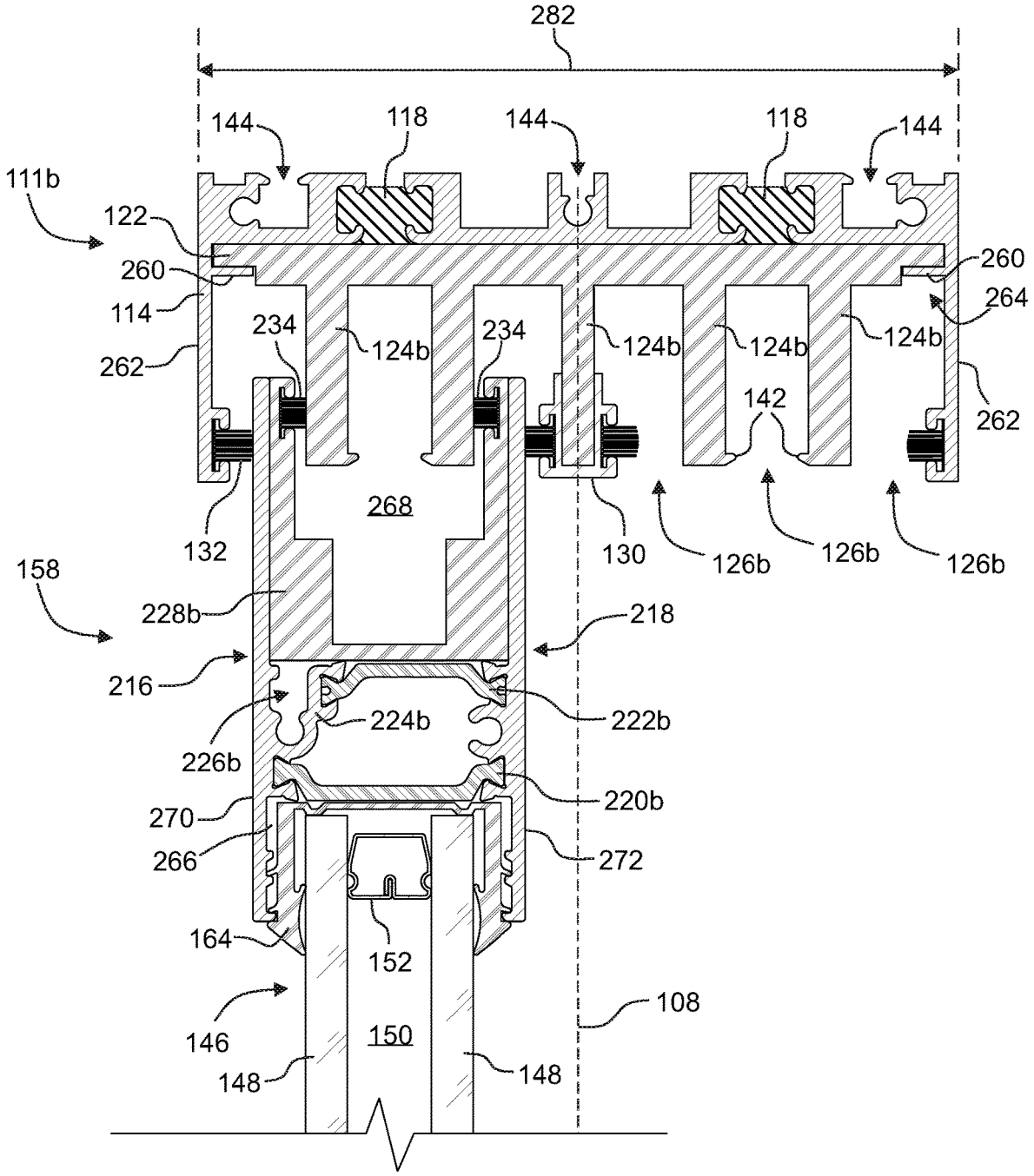
FIG. 10 is a diagrammatic cross-sectional view taken along line 10-10 of FIG. 1, illustrating an example distal rail of a panel element in guided engagement with an example distal track of a framework.

Referring to FIG. 10, the framework 102 may include a distal track 111*b* and a corresponding first panel element 104 may include a proximal rail 158. The distal track 111*b* may have a distal track frame member 114 and a distal track insert 122. The distal track frame member 114 may include a pair of distal transverse facing walls 262 defining a distal insert channel 264 therebetween. The distal track insert 122 may be disposed within the distal insert channel 264 and may have a plurality of distal track channel walls 124*b* defining distal track channels 126*b* interposed laterally thereof. The distal track insert 122 may be retained within the distal insert channel 264 by way of insert detents 260 protruding inwardly from the distal transverse facing walls 262.

Referring again to FIG. 10, the distal rail 158 may have a distal rail first section 216, a distal rail second section 218, distal rail glazing channel 266, a distal shoe channel 268, a distal first thermal break 220*b* and a distal second thermal break 222*b*. The distal rail first section 216 may have a distal first facing wall 270. The distal rail second section 218 may be materially discontinuous with the distal rail first section 216 and may have a distal second facing wall 272 disposed oppositely of the distal first facing wall 270. The distal rail glazing channel 266 may be in receiving engagement with one of the peripheral edge portions of the respective glazing element 146 and may be defined between the distal first and second facing walls. The distal shoe channel 268 may also be defined between the distal first and second facing walls, but disposed oppositely of the distal rail glazing channel 266. A distal rail shoe 228*b* may be disposed within the distal shoe channel 268. Shoe brush strips 234 may be affixed to the distal rail shoe to laterally-engage respective distal track channel walls 124*b*. The distal first thermal break 220*b* may be secured in coupling communication between the distal first and second facing walls. Similarly, the distal second thermal break 222*b* may be secured in coupling communication between the distal first and second facing walls.

Figure 20:
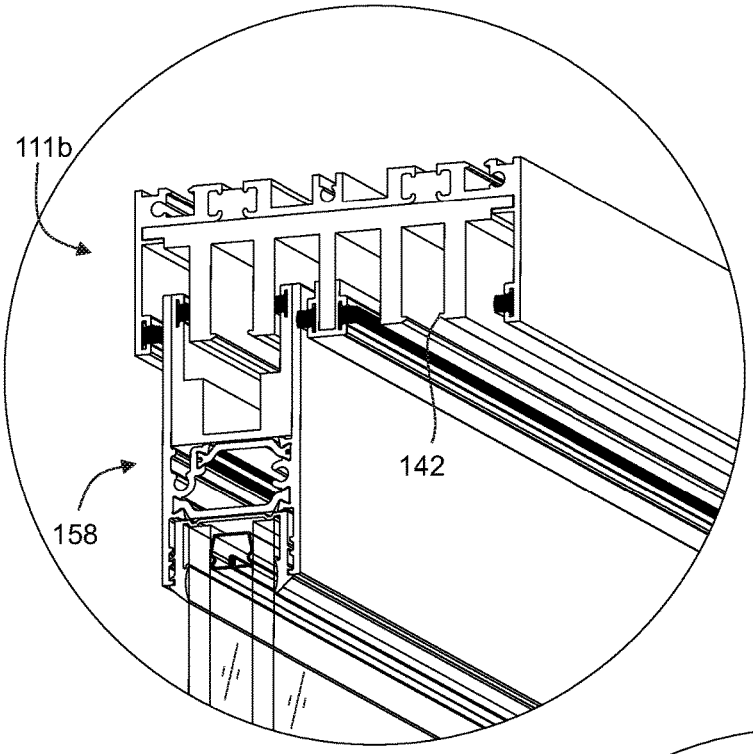
FIG. 20 is a diagrammatic magnified perspective view of a sectioned portion of the fenestration assembly shown in FIG. 1, wherein the section cut is along line 10-10 in FIG. 1, and a slidable guiding engagement between an example distal rail and an example distal track is illustrated.

In certain preferred implementations of the slidable fenestration assembly 100 with interfacing distal track and rail subassemblies (e.g., as illustrated in FIGS. 10 and 20), the distal track insert 122 may have a relatively low thermal conductivity compared to all or portions of the distal track frame member 114. For example, the distal track insert 122 may be comprised of PVC, another polymer with low thermal conductivity, or the like. In contrast, the distal track frame member 114 may be comprised primarily of aluminum, with frame thermal breaks 118 comprising polyurethane or the like (e.g., formed by "pour and debridge" process). The distal first thermal break 220*b*, distal second thermal break 222*b*, and the distal rail shoe 228*b* may have relatively low thermal conductivities compared to the distal rail first section 216 and distal rail second section 218. For example, the distal first thermal break 220*b* and distal second thermal break 222*b* may be comprised of 6/6 polyamide Nylon or the like, and the distal rail shoe 228*b* may comprise PVC, another polymer with low thermal conductivity, or the like. In contrast, the distal rail first section 216 and distal rail second section 218 may comprise aluminum or the like. The distal rail first section 216 and distal rail section 218 may be partially received by respective said distal track channels 126*b*.

Referring to FIG. 9, in particular preferred implementations of the proximal rail 156, the proximal rail first section 216 may include a proximal break offset portion 224*a* defining a proximal relief channel 226*a* which may open toward the proximal shoe channel 254. In such implementations, the proximal second thermal break 222*a* may be secured to the proximal first facing wall 216 by way of the proximal break offset portion 224*a*. Similarly, referring to FIG. 10, in particular preferred implementations of the distal rail 158, the distal rail first section 216 may include a proximal break offset portion 224*b* defining a distal relief channel 226*b* which may open toward the distal shoe channel 268. In such implementations, the distal second thermal break 222*b* may be secured to the distal first facing wall 216 by way of the distal break offset portion 224*b*. The relief channels (226*a* and 226*b*) uniquely provide improved clearance for protruding features of an automated crimping tool used to crimpingly secure the thermal breaks in coupling communication with respective first and second facing walls.

Figure 23:
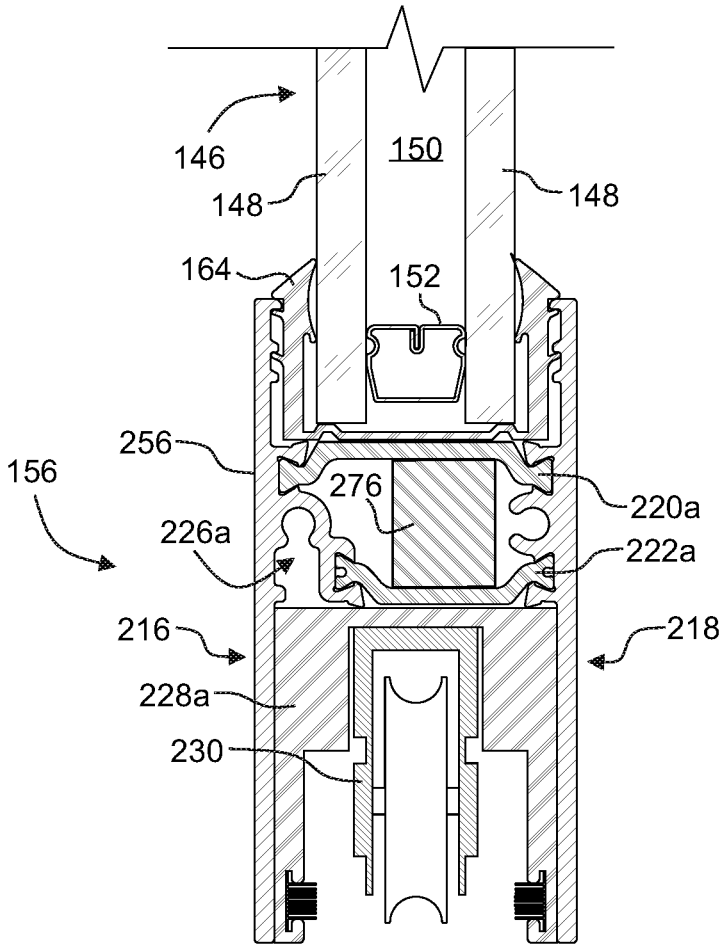
FIG. 23 is a diagrammatic cross-sectional view of an alternative implementation of a proximal rail, wherein a rail auxiliary break is disposed between the first and second thermal breaks.
Figure 24:
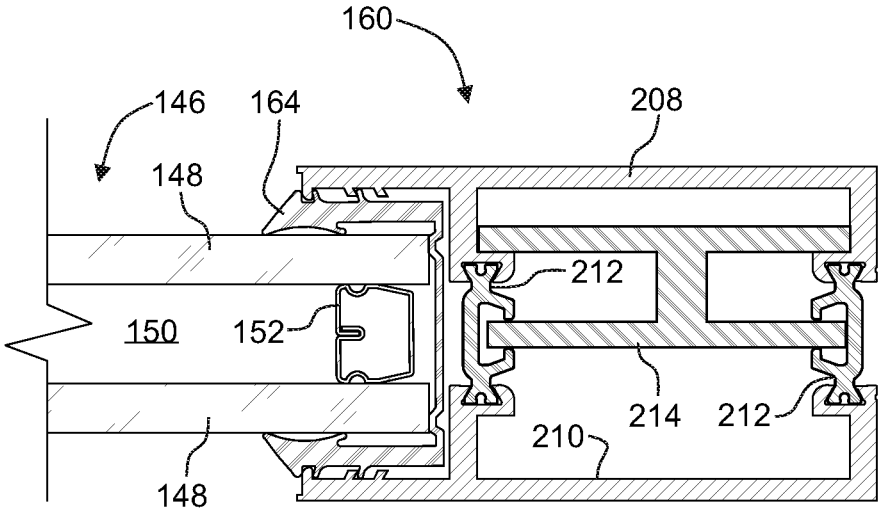
FIG. 24 is a diagrammatic cross-sectional view of an alternative end stile, wherein an auxiliary thermal break is secured between two end stile thermal breaks, and includes two parallel longitudinal segments extending the length of the end stile cavity.
Figure 25:
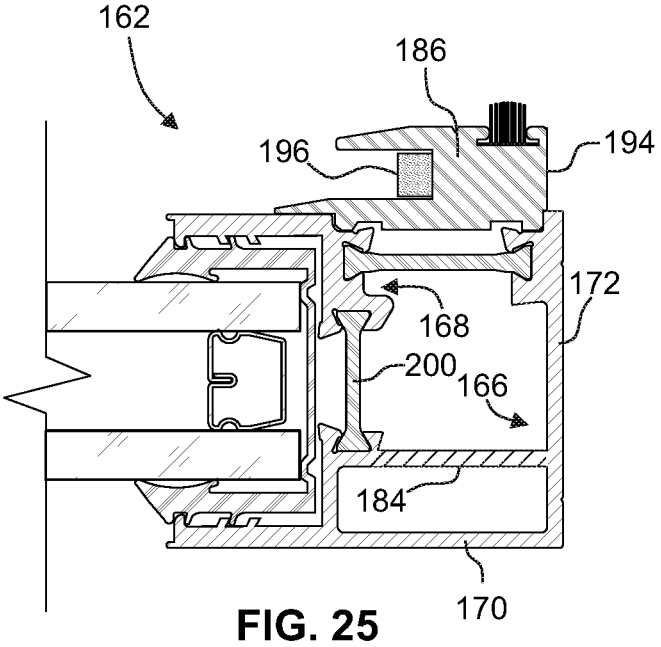
FIG. 25 is a diagrammatic cross-sectional view of a further alterative implementation of an interlock stile, wherein an interlock bracing wall extends to the lateral facing wall in parallel with the outer facing wall.

Referring to FIG. 23, in particular implementations of a rail subassembly (e.g., 158 or 158), a rail auxiliary break 276 may be inserted between the first and second thermal breaks. The rail auxiliary break 276 may be comprised of PVC or the like.

Particular implementations of a sliding fenestration assembly 100 with interfacing track and rail subassemblies (such as those illustrated in FIGS. 9 and 10) may comprise a framework 102 including a track (e.g., 111*a* or 111*b*), and a panel element 104 including a rail (e.g., 156 or 158). In such implementations, the track may include a track element 128 disposed within a respective track channel (e.g., 126*a*) and configured to supportingly and guidingly engage a wheel 232 of a wheel assembly 230. The track insert (e.g., 120) may have a relatively low thermal conductivity compared to the track frame member (e.g., 111*a*) and the track element 128, and may be disposed in thermally-insulative communication therebetween. The track (e.g., 111*a* or 111*b*) may include a brush strip mounting adaptor 130 in receiving engagement with an end of a track channel wall (e.g., 124*a* or 124*b*), and a pair of opposingly-disposed track brush strips 132. One of the track brush strips 132 may be affixed to the brush strip mounting adaptor 130, and another of the track brush strips 132 may be affixed to one of the transverse facing walls (e.g., 248 or 262). The brush strip mounting adaptor 130 may preferably be comprised of aluminum or the like. In the alternative, the brush strip mounting adaptor 130 may be comprised of PVC or other polymer with relatively low conductivity (e.g., compared to aluminum).

Figure 8:
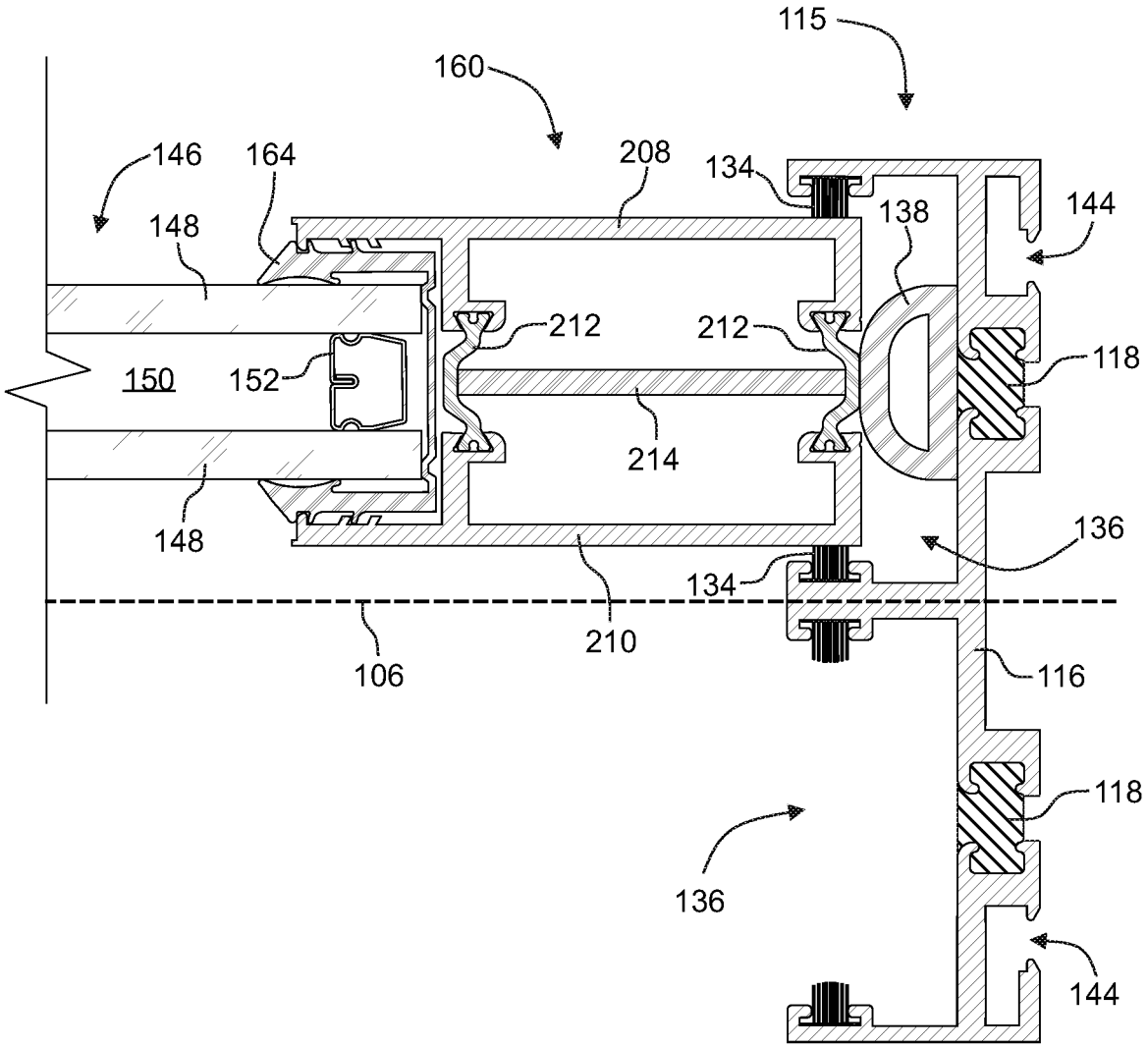
FIG. 8 is a diagrammatic cross-sectional view taken along line 8-8 of FIG. 1, illustrating an example end stile in sealed configuration against a jamb.

Referring to FIG. 8, a jamb 115 may comprise a jamb frame member 116 having one or more jamb channels 136, a jamb bumper 138 and jamb brush strips 135. The jamb frame member 116 may be comprised primarily of aluminum, with frame thermal breaks 118 comprising polyurethane or the like. The jamb bumper 138 may be comprised of, for example, a self-adhesive sponge neoprene or the like. An end stile 160 may comprise an end stile first section 208, and end stile second section 210, and a pair of end stile thermal breaks 212. The end stile thermal breaks may be comprised of 6/6 Polyamide Nylon or the like. Contrastingly, the end stile first section 208, and end stile second section 210 may be comprised of aluminum. An auxiliary thermal break 214 may be provided, and may be comprised of PVC, another polymer with low thermal conductivity, or the like.

Figure 20A:
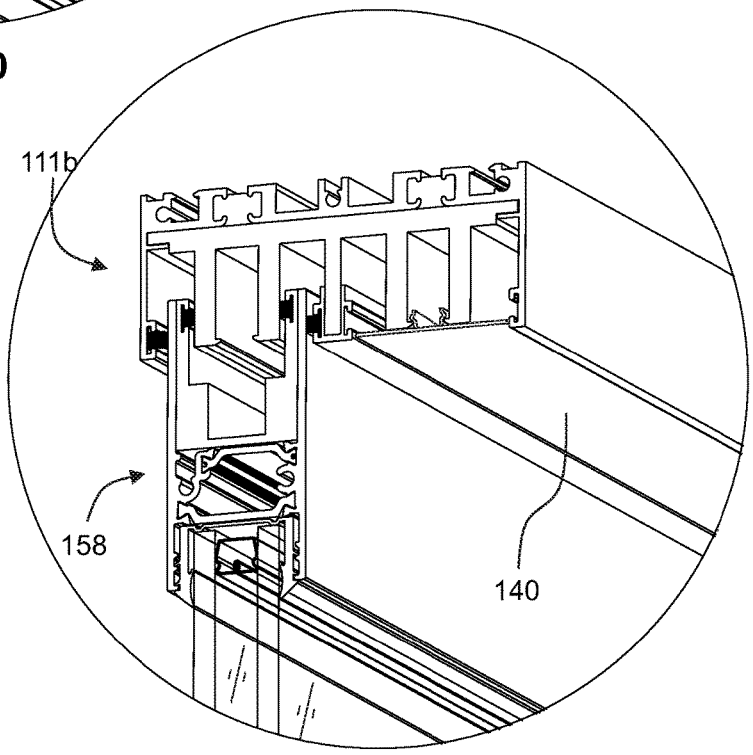
FIG. 20A is a diagrammatic magnified perspective view similar to that of FIG. 20, but wherein an unoccupied portion of the track insert is concealed by a removably-attachable track shroud.

Referring to FIGS. 20 and 20A, a track shroud 140 may be provided to be removably attached to the track insert (e.g., by way of engagement between flexible clip arms and shroud clip detents 142). This may be useful primarily for aesthetic reasons, to conceal a portion of a track that will not be occupied by a panel element 104. The track shroud 140 may preferably be comprised of aluminum or other material that matches the material and appearance of the adjacent track frame members or sash components.

It is envisioned that in certain implementations of a slidable fenestration assembly 100, the glazing element 146 may be substituted by an opaque panel comprising, for example, wood, MDX, or the like. Moreover, the glazing element or its substitute opaque panel may be non-planar.

Referring to FIGS. 9 and 10, the track (e.g., 111*b* and 111*b*) and/or jambs 115 may have a transverse width 282, the size of which will depend upon, for example, the application of the fenestration assembly 100 and number of slidable panel elements incorporated therein. For example, in certain implementations of the assembly 100 with a dual-panel configuration, the transverse width 282 may be 4.5335 inches. However, other widths and dimensions are possible in alternative implementations. Moreover, the other features and components shown in the corresponding figures may have dimensions which may be proportionally deduced from the respective transverse width 282.

As would be readily-apparent to a person having ordinary skill in the relevant art with the benefit of this disclosure, many or most of the components disclosed herein, particularly the metal and polymer components which are elongated and have constant cross-sections, may be preferably formed by conventional extrusion processes.

While embodiments of the invention have been illustrated and described, it is not intended that these embodiments illustrate and describe all possible forms of the invention. Various changes, modifications, and alterations in the teachings of the present invention may be contemplated by those skilled in the art without departing from the intended spirit and scope thereof. It is intended that the present invention encompass such changes and modifications.

What is claimed is:

1. A slidable fenestration assembly comprising:

a first panel element and a second panel element, the first panel element being slidably movable along a longitudinal axis between an open position and a closed position with respect to the second panel element, the first panel element including a glazing element being planar and having peripheral edge portions; and a framework within which the panel elements are mounted, wherein the framework includes a proximal track having (i) a proximal track frame member with a pair of proximal transverse facing walls defining a proximal insert channel therebetween;

(ii) a proximal track insert disposed within the proximal insert channel and having a plurality of proximal track channel walls defining proximal track channels interposed laterally thereof, (iii) a track element disposed within a respective said proximal track channel;

the first panel element further includes a proximal rail having (i) a proximal rail first section with a proximal first facing wall;

(ii) a proximal rail second section being materially discontinuous with the proximal rail first section and having a proximal second facing wall disposed oppositely of the proximal first facing wall;

(iii) a proximal rail glazing channel in receiving engagement with one of the peripheral edge portions of the glazing element and defined between the proximal first and second facing walls;

(iv) a proximal shoe channel defined between the proximal first and second facing walls;

(v) a proximal rail shoe disposed within the proximal shoe channel;

(vi) one or more roller assemblies disposed within the proximal rail shoe and having one or more wheels in engagement with the track element;

(vii) a proximal first thermal break secured in coupling communication between the proximal first and second facing walls; and (viii) a proximal second thermal break secured in coupling communication between the proximal first and second facing walls;

the proximal track insert has relatively low thermal conductivity compared to all or portions of the proximal track frame member and the track element, and is disposed in thermally-insulative communication between the proximal track frame member and the track element; and the proximal first and second thermal breaks and the proximal rail shoe have relatively low thermal conductivities compared to the proximal rail first and second sections.

2. A slidable fenestration assembly as defined in claim 1, wherein the framework includes a distal track having (i) a distal track frame member with a pair of distal transverse facing walls defining a distal insert channel therebetween; and (ii) a distal track insert disposed within the distal insert channel and having plurality of distal track channel walls defining distal track channels interposed laterally thereof;

the first panel element further includes a distal rail having (i) a distal rail first section with a distal first facing wall;

(ii) a distal rail second section being materially discontinuous with the distal rail first section and having a distal second facing wall disposed oppositely of the distal first facing wall;

(iii) a distal rail glazing channel in receiving engagement with one of the peripheral edge portions of the respective glazing element and defined between the distal first and second facing walls;

(iv) a distal shoe channel defined between the distal first and second facing walls;

(v) a distal rail shoe disposed within the distal shoe channel;

(vi) a distal first thermal break secured in coupling communication between the distal first and second facing walls; and (vii) a distal second thermal break secured in coupling communication between the distal first and second facing walls;

the distal track insert has relatively low thermal conductivity compared to all or portions of the distal track frame member;

the distal first and second thermal breaks and the distal rail shoe have relatively low thermal conductivities compared to the distal rail first and second sections; and the distal rail first and second sections are partially received by respective said distal track channels.

3. A slidable fenestration assembly as defined in claim 2, wherein (a) the proximal rail first section includes a proximal break offset portion defining a proximal relief channel which opens toward the proximal shoe channel;

(b) the proximal second thermal break is secured to the proximal first facing wall by way of the proximal break offset portion;

(c) the distal rail first section includes a distal break offset portion defining a distal relief channel which opens toward the distal shoe channel; and (d) the rail second thermal break is secured to the proximal first facing wall by way of the distal break offset portion.

4. A slidable fenestration assembly comprising:

a framework including a track having (a) a track frame member with a pair of transverse facing walls defining an insert channel therebetween; and (b) a track insert disposed within the insert channel and having plurality of track channel walls defining track channels interposed laterally thereof;

a panel element slidably mounted within the framework, and including (a) a glazing element being planar and having peripheral edge portions; and (b) a rail having (i) a rail first section with a first facing wall;

(ii) a rail second section being materially discontinuous with the rail first section and having a second facing wall disposed oppositely of the first facing wall;

(iii) a rail glazing channel in receiving engagement with one of the peripheral edge portions of the glazing element and defined between the first and second facing walls;

(iv) a shoe channel defined between the first and second facing walls;

(v) a rail shoe disposed within the rail shoe channel;

(vi) a first thermal break secured in coupling communication between the first and second facing walls; and (vii) a second thermal break secured in coupling communication between the first and second facing walls;

wherein (a) the track insert has relatively low thermal conductivity compared to all or portions of the track frame member;

(b) the first and second thermal breaks and the rail shoe have relatively low thermal conductivities compared to the rail first and second sections; and (c) the rail first and second sections are partially received by respective said track channels.

5. A slidable fenestration assembly as defined in claim 4, wherein (a) the track includes a track element disposed within a respective said track channel, the track element being configured to supportingly and guidingly engage a wheel of a wheel assembly; and (b) the track insert has relatively low thermal conductivity compared to the track frame member and the track element, and is disposed in thermally-insulative communication therebetween.

6. A slidable fenestration assembly as defined in claim 4, wherein the track includes (a) a brush strip mounting adaptor in receiving engagement with an end of a said track channel wall; and (b) a pair of opposingly-disposed track brush strips, one of the track brush strips being affixed to the brush strip mounting adaptor, the other of the track brush strips being affixed to one of the transverse facing walls.

* * * * *